United States Patent [19]

DeLong

[11] 4,249,712

[45] Feb. 10, 1981

[54] ADJUSTABLE HEADREST

[76] Inventor: Harold D. DeLong, 1483 Manzanita Ave., Escondido, Calif. 92027

[21] Appl. No.: 25,998

[22] Filed: Apr. 2, 1979

[51] Int. Cl.[3] ..... B68G 5/00

[52] U.S. Cl. ..... 248/118; 248/279

[58] Field of Search ..... 248/124, 286, 278, 279, 248/324, 325, 118; 403/362, 110

[56] References Cited

U.S. PATENT DOCUMENTS

| | | | |
|---|---|---|---|
| 72,344 | 12/1867 | Welch | 403/362 X |
| 296,332 | 4/1884 | Hartman | 403/362 X |
| 344,883 | 7/1886 | Trow | 248/288 |
| 967,877 | 8/1910 | Bauer | 248/281.1 |
| 1,260,929 | 3/1918 | Maxcy | 248/118 X |
| 1,266,367 | 5/1918 | Wilson | 248/118 X |
| 1,632,160 | 6/1927 | Barnes | 248/118 X |
| 2,019,789 | 11/1935 | Mahannah | 248/279 X |
| 2,860,538 | 11/1958 | Bruet | 403/362 X |
| 3,669,118 | 6/1972 | Morales | 248/124 |

*Primary Examiner*—J. Franklin Foss

*Attorney, Agent, or Firm*—Ralph S. Branscomb

[57] ABSTRACT

The invention is a support which can be releasably attached to a table, or the like, and which extends across the table to support the forehead of a person who is leaning over the table engaged in work such as drafting, reading fine print or the like. The device is triply adjustable to conform to the position of the forehead and to swing out of the way when not in use.

1 Claim, 5 Drawing Figures

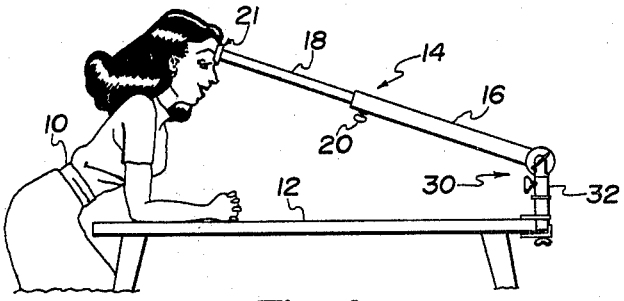
Fig. 1
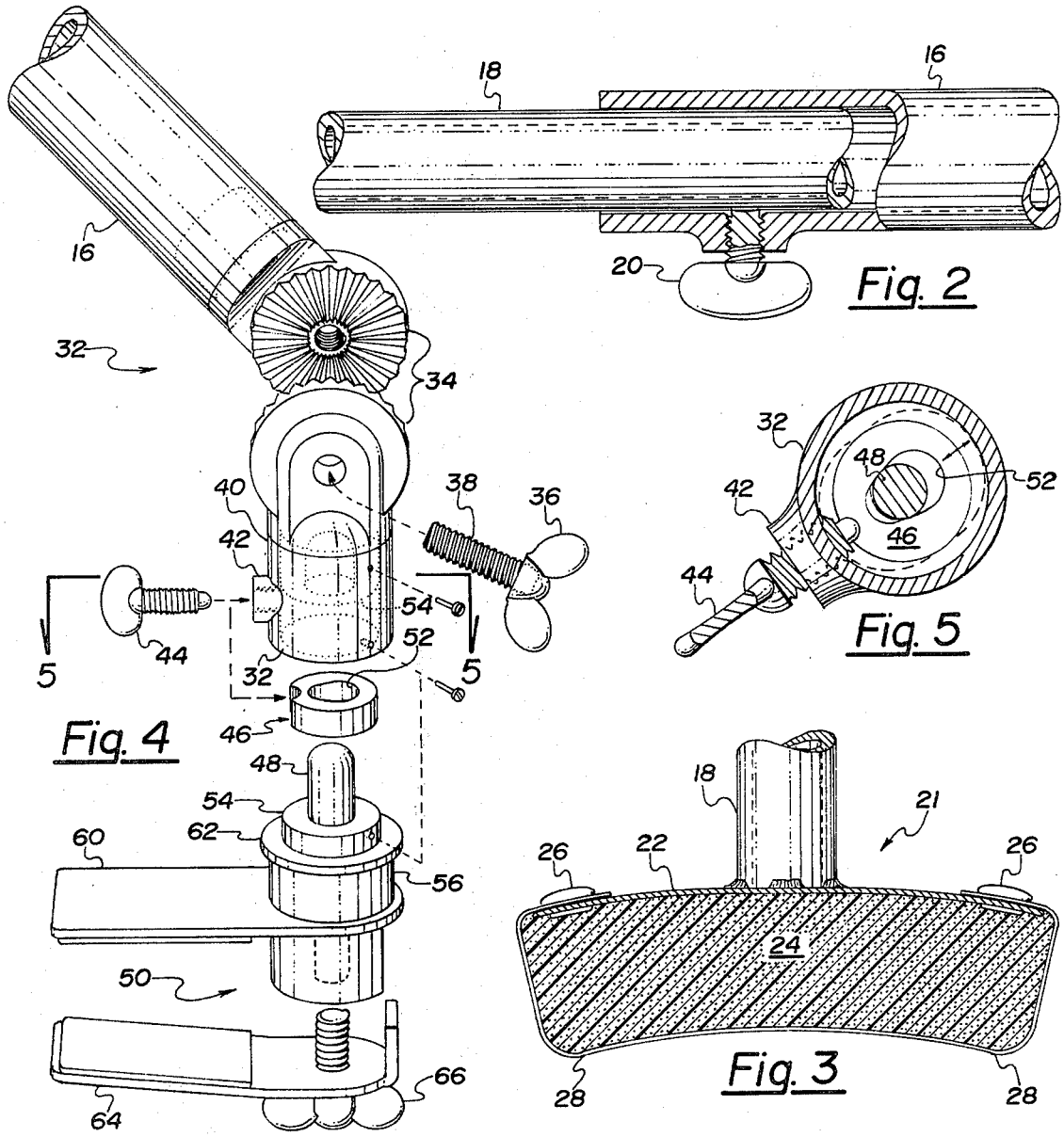
Fig. 2
Fig. 4
Fig. 5
Fig. 3

ADJUSTABLE HEADREST

BACKGROUND OF THE INVENTION

Many people who are required to work at deck jobs experience pain, aching and discomfort of the upper neck and back after working many hours hunched over a desk or table. In some occupations this problem is more severe than others, such as drafting, jeweler's work, and other occupations in which one must work with the hands on the table and bent over somewhat to see the work more closely.

It has been found that a person engaged in this type of occupation or hobby can receive a great deal of relief from resting the head propped or supported against some stable object for just a few minutes while taking a break from the job. However, heretofore it has been necessary to stop working in order to achieve the relief incumbent in such a break.

SUMMARY OF THE INVENTION

The present invention permits the user to continue working along while simultaneously obtaining the benefit of resting his head and thus relieving his neck and upper shoulders. The invention comprises a boom which is mounted by a releasable clamp to the opposite side of the table or a desk at which the person is working. The boom has telescopic extension to accommodate desks and tables of different depths, as well as an elevational adjustment and a swivel means with an adjustable friction clutch permitting swiveling of the entire boom structure about the vertical axis at the clamping point to permit moving the structure out of the way when not in use. A removable chamois retains a sponge pad to an arcuate forehead rest to comfortably support the head when in use.

BRIEF DESCRIPTION OF THE DRAWINGS

FIG. 1 is a side elevation view showing the invention in use;

FIG. 2 is a side elevation view of a detail of the invention with portions cut away revealing the extension set screw;

FIG. 3 is a horizontal section through the headrest element;

FIG. 4 is an exploded perspective of the elevation adjustment mechanism; and FIG. 5 is a vertical section through the friction adjust clutch.

DETAILED DESCRIPTION OF THE PREFERRED EMBODIMENT

The invention is shown in FIG. 1 in which a person 10 is working at a table 12 while at the same time resting his head against the boom 14. The boom has a major portion having a substantial horizontal directional component, and this portion is telescopically adjustable having an outer lower segment 16 and the telescopically received segment 18 which is fixed at the desired degree of extension by means of set screws 20 as shown in FIG. 2. At the upper end of this portion is an arcuate cradle 22 which back stops a sponge or other pad 24. The member 22 is brazed, bolted, or otherwise connected to the extended end of the boom 14 and by virtue of snaps 26 positioned on the back of the cradle 22 a cover 28, such as chamois skin, is used to attch the pad 24 to the cradle. The contour of the cradle, coupled with the sponge pad 24 and the chamois surface provide a very comfortable, substantially form fitted headrest upon which the user can rest his forehead.

The upper portion of the boom is jointed at 30 to a vertical segment 32. The joint 30 is adjustable by virtue of the two mating, radially serrated discs 34 mated by finger-adjustable wing nut 36 and bolt 38. Engagement of these two discs at any of a multiplicity of angularly adjusted settings provides a variety of elevations at the end of the boom for the headrest 21.

The vertical segment 32 as it extends away from the disc 34 comprises an outer cylindrical sleeve 40 with a radial screw bore 32 through which set screw 34 engages to compress wedge insert 46, which acts as a clutch, at varying degrees of compression against upright cylindrical stud 48 which is mounted to the base member 50 of the apparatus. The wedge insert 46 has a tapered-walled opening 52 which receives the stud 48, and increased pressure exerted by the set screw 44 clearly increases the friction on this stud and thereby makes it more difficult for the boom 14 to swing in an azimuthal fashion and because the insert 46 rotates and the captured stud 48 is stationary. The stud is journaled by a pair of bushings 54 which sandwich the wedge insert 46 into position.

The main portion of the base 50 comprises a plug 56 with a threaded bore 58 entering the plug from the bottom, and an upper clamp member 60 is captured beneath a flange 62 at the top of the plug 56 and a lower clamp member 64 is captured by set bolt 66 to compress the edge of a table, or the like, between the two clamp members.

The base 50 and the means of clamping the structure to a table are, of course, subject to a wide variation within the skill of one competent in the art, and the same is true of the joint mechanism 30 and the telescopic extension structure and the precise nature of the headrest. It is the intent of the inventor and the purpose of the invention as disclosed and claimed herein, to provide a device which is easily attachable to virtually any structure and which is adjustable both as to elevation and horizontally forward-to-rear to assure that the headrest can be positioned to provide optimum relief to the user. The provision of the clutch structure around the vertical axis insures that the boom is sufficiently secure against azimuthal slippage while in use to avoid accidents and yet enables the boom to be pushed aside when not in use without requiring the release of a fixed lock mechanism. As described and claimed herein, the device is economical to manufacture and of great theraputic benefit to anyone who is required to spend hours hunched over a desk and will undoubtedly be especially welcomed in those occupations requiring the execution of fine work on a desk top.

I claim:

1. An elongated headrest comprising:

(a) a base having a releasable clamp for attachment to the far edge of a horizontal table;

(b) an upright cylindrical stud extending from said base;

(c) a vertical bore defined in said boom receiving said stud;

(d) a clutch comprising an insert having a wedge-shaped opening engaged over said stud and a pressure-applying member fixed in said boom adjacent said bore to wedge said insert against said stud;

(e) said boom defining a short, vertical segment and elongated straight cantilevered segment, said vertical segment defining said bore in its bottom and having an adjustable locking joint at its top connecting two segments together;

(f) said upper cantilevered segment being defined in two locking telescoping components; and (g) a forehead cradle mounted on the distal end of said cantilevered boom segment, whereby said headrest is universally adjustable azimuthally, elevationally, and longitudinally, and minimizes stress on said table by virtue of the low-torque attachment to the edge thereof.

* * * * *